US007811094B2

(12) United States Patent
Kuwahara et al.

(10) Patent No.: US 7,811,094 B2
(45) Date of Patent: Oct. 12, 2010

(54) CONTACT MEMBER AND CONNECTOR

(75) Inventors: Takashi Kuwahara, Tokyo (JP); Seiya Takahashi, Tokyo (JP); Hiroshi Akimoto, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/256,625

(22) Filed: Oct. 23, 2008

(65) Prior Publication Data

US 2009/0130924 A1 May 21, 2009

(30) Foreign Application Priority Data

Nov. 19, 2007 (JP) ..... 2007-299285

(51) Int. Cl.
*H01R 12/00* (2006.01)

(52) U.S. Cl. ..... 439/67; 439/66

(58) Field of Classification Search ..... 439/66, 439/67

See application file for complete search history.

(56) References Cited

U.S. PATENT DOCUMENTS 5,259,770 A * 11/1993 Bates et al. ..... 439/66

FOREIGN PATENT DOCUMENTS

JP 2006-310140 A 11/2006

* cited by examiner

*Primary Examiner*—Ross N Gushi

(74) *Attorney, Agent, or Firm*—Holtz, Holtz, Goodman & Chick, PC

(57) ABSTRACT

A contact member which is resistant to contact failure even if the environment of use is bad. A film is affixed to the surface of a long plate-shaped elastic body which is disposed between two to-be-connected objects. A electrically-conducting path which electrically connects between terminal portions of two to-be-connected objects is provided on the surface of the film. A first conductor contact portion which is capable of being brought into contact with the terminal portion of one of two to-be-connected objects is disposed at one end of the electrically-conducting path, and a second conductor contact portion which is capable of being brought into contact with the terminal portion of the other of two to-be-connected objects is disposed at the other end of the electrically-conducting path. A plurality of holes are formed in the first and second conductor contact portions.

10 Claims, 16 Drawing Sheets

CONTACT MEMBER AND CONNECTOR

BACKGROUND OF THE INVENTION

1. Field of the Invention

This invention relates to a contact member that electrically connects to-be-connected objects to each other, and a connector including the contact member.

2. Description of the Related Art

Conventionally, there has been proposed a connector comprised of contact members and a frame (see Japanese Laid-Open Patent Publication (Kokai) No. 2006-310140 (Paragraphs 0022 to 0025 and 0039 to 0041, and FIGS. 1 and 7)).

Each contact member includes an elastic body, a film, and a plurality of conductor portions.

The elastic body is substantially long plate-shaped, and includes a holding surface which holds the film, a lower surface which is parallel to the holding surface, and curved surfaces extending between the holding surface and the basic surface. The cross-section of the elastic body is substantially D-shaped.

The film is affixed to the elastic body in a manner covering the holding surface and the curved-faces thereof.

Each of the conductor portions is a substantially belt-shaped metal thin film. The conductor portions extend in the direction of width of the elastic body (in the direction orthogonal to the longitudinal direction and the direction of thickness of the elastic body), and are formed on the surface of the film at equally-spaced intervals along the longitudinal direction of the elastic body.

The frame is formed with holding holes. The contact members are inserted into the holding holes, respectively, and an intermediate portion of each contact member in the direction of width thereof is held by the frame.

When in use, the connector is sandwiched between two to-be-connected objects. At this time, the elastic body is elastically deformed, and the conductor portions are pressed against terminal portions of the to-be-connected objects by the restoring force of the elastic body for restoring the original shape, whereby the two to-be-connected objects are electrically connected via the conductor portions.

However, the conductor portions of the contact member are brought into surface contact with the terminal portions of the to-be-connected objects, and hence if an environment in which the connector is used is bad (for example, if dust falls, or if terminal portions of a CPU (Central Processing Unit) as a to-be-connected object are stained with silicone oil applied thereto for improvement of heat dissipation effects), silicone oil or dust is liable to be held between the conductor portions and the terminal portions, which can cause contact failure.

SUMMARY OF THE INVENTION

The present invention has been made in view of these circumstances, and an object thereof is to provide a contact member which is resistant to contact failure even if the environment of use is bad, and a connector including the contact member.

To attain the above object, in a first aspect of the present invention, there is provided a contact member comprising an elastic body that is substantially plate-shaped, a film that is affixed to a surface of the elastic body, and an electrically-conducting path that is disposed on the surface of the film, for electrically connecting between terminal portions of two to-be-connected objects, the electrically-conducting path including a first conductor contact portion that is capable of being brought into contact with a terminal portion of one of the two to-be-connected objects, and a second conductor contact portion that is capable of being brought into contact with a terminal portion of the other of the two to-be-connected objects, the first and second conductor contact portions having recesses formed therein.

With the arrangement of the contact member according to the first aspect of the present invention, recesses are formed in the first and second conductor contact portions. Therefore, when the conductor contact portions are brought into contact with the terminal portions of the to-be-connected objects, dust or the like attached to the conductor contact portions are caught in the recesses. Therefore, even if the environment of use is bad, the contact member is resistant to contact failure.

Preferably, the recesses are scattered over substantially whole of the first and second conductor contact portions.

To attain the above object, in a first aspect of the present invention, there is provided a contact member comprising an elastic body that is substantially plate-shaped, a film that is affixed to a surface of the elastic body, and an electrically-conducting path that is disposed on the surface of the film, for electrically connecting between terminal portions of two to-be-connected objects, the electrically-conducting path including a first conductor contact portion that is capable of being brought into contact with a terminal portion of one of the two to-be-connected objects, and a second conductor contact portion that is capable of being brought into contact with a terminal portion of the other of the two to-be-connected objects, the first and second conductor contact portions having holes formed therein.

With the arrangement of the contact member according to the second aspect of the present invention, holes are formed in the first and second conductor contact portions. Therefore, when the conductor contact portions are brought into contact with the terminal portions of the to-be-connected objects, dust or the like attached to the conductor contact portions are caught in the holes. Therefore, even if the environment of use is bad, the contact member is resistant to contact failure.

Preferably, deformation acceleration holes opposed to the holes are formed in the film.

Preferably, a conductor layer continuing into the electrically-conducting path is formed on an inner peripheral surface of each of the holes.

Preferably, the holes are scattered over substantially whole of the first and second conductor contact portions.

To attain the above object, in a third aspect of the present invention, there is provided a connector comprising a contact member including an elastic body that is substantially plate-shaped, a film that is affixed to a surface of the elastic body, and an electrically-conducting path that is disposed on the surface of the film, for electrically connecting between terminal portions of two to-be-connected objects, the electrically-conducting path including a first conductor contact portion that is capable of being brought into contact with a terminal portion of one of the two to-be-connected objects, and a second conductor contact portion that is capable of being brought into contact with a terminal portion of the other of the two to-be-connected objects, the first and second conductor contact portions having recesses formed therein, and an insulating frame that holds the contact member.

With the arrangement of the contact according to the third aspect of the present invention, it is possible to obtain the same advantageous effects as provided by the first aspect of the invention.

To attain the above object, in a fourth aspect of the present invention, there is provided a connector comprising a contact member including an elastic body that is substantially plate-shaped, a film that is affixed to a surface of the elastic body, and an electrically-conducting path that is disposed on the surface of the film, for electrically connecting between terminal portions of two to-be-connected objects, the electrically-conducting path including a first conductor contact portion that is capable of being brought into contact with a terminal portion of one of the two to-be-connected objects, and a second conductor contact portion that is capable of being brought into contact with a terminal portion of the other of the two to-be-connected objects, the first and second conductor contact portions having holes formed therein, and an insulating frame that holds the contact member.

With the arrangement of the contact according to the third aspect of the present invention, it is possible to obtain the same advantageous effects as provided by the second aspect of the invention.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
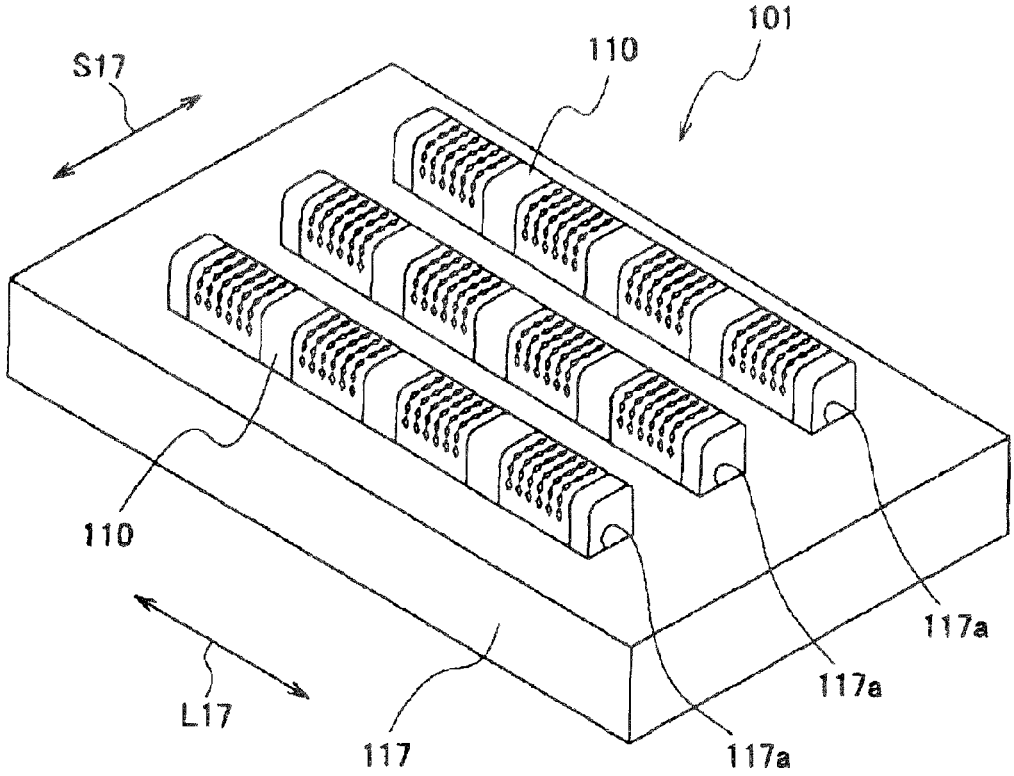
FIG. 1 is a perspective view of a connector according to a first embodiment of the present invention.

FIG. 1 is a perspective view of a connector according to a first embodiment of the present invention.

As shown in FIG. 1, a connector 101 is comprised of a plurality of contact members 110, and an insulating frame 117. The connector 101 is disposed between two to-be-connected objects (not shown), and electrically connects the to-be-connected objects to each other.

Figure 2:
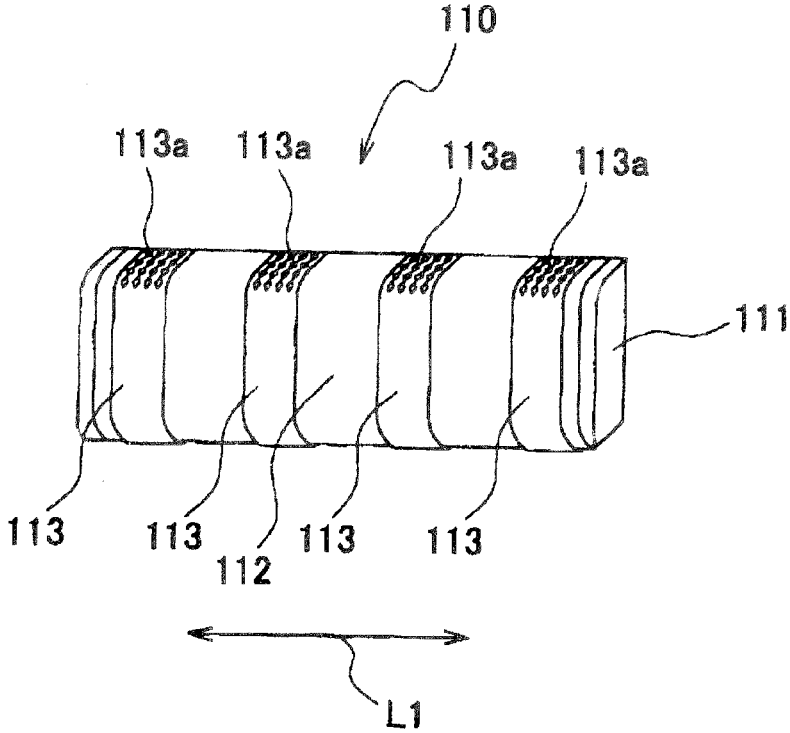
FIG. 2 is a perspective view of a contact member of the connector shown in FIG. 1.
Figure 3:
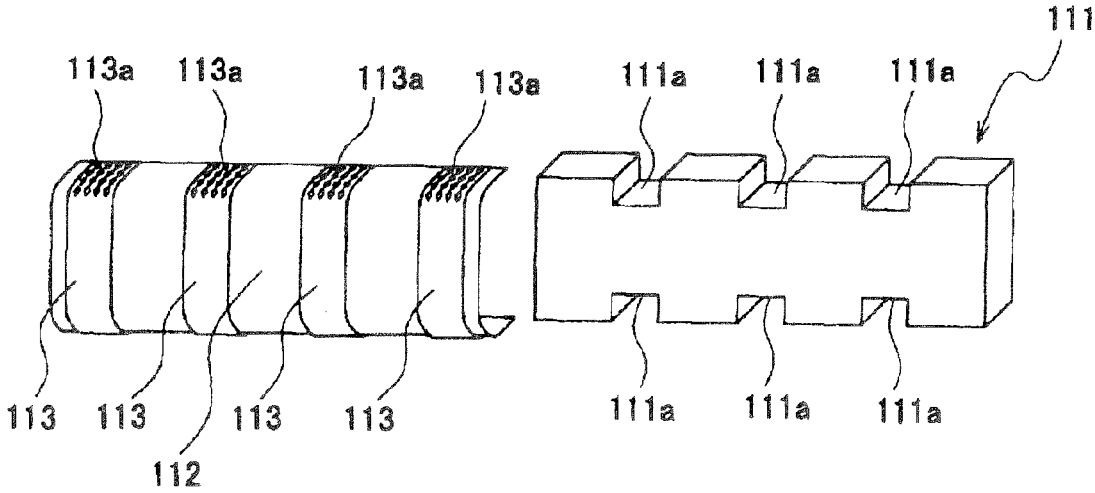
FIG. 3 is an exploded perspective view of the contact member shown in FIG. 2.
Figure 4:
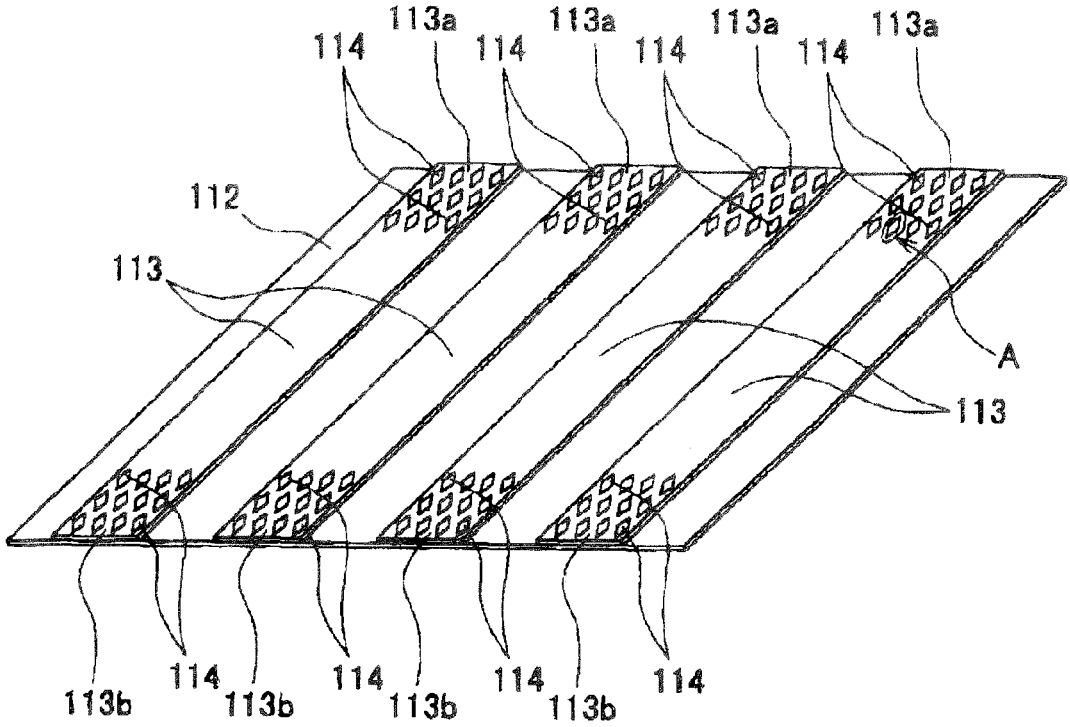
FIG. 4 is a perspective view of a film and electrically-conducting paths of the FIG. 2 contact member, in a developed state.

As shown in FIGS. 2 to 4, each contact member 110 includes an elastic body 111, a film 112, and a plurality of electrically-conducting paths 113.

The elastic body 111 is made of an elastic material having insulation properties (e.g. gum or gel), and is substantially plate-shaped.

The elastic body 111 has cutouts 111*a* formed in upper and lower ends thereof at equally-spaced intervals in a longitudinal direction L1 of the elastic body 111 (see FIG. 3).

The film 112 is affixed to the elastic body 111 in a manner covering an upper surface, a front surface, and a lower surface of the elastic body 111. Polyimide, aramid or the like is suitable for the material of the film 112.

The electrically-conducting paths 113 are formed on the surface of the film 112 at equally-spaced intervals along the longitudinal direction L1 of the elastic body 111. Each electrically-conducting path 113 is a substantially belt-shaped metal thin film. The electrically-conducting path 113 is formed e.g. by sputtering and etching. The electrically-conducting path 113 has a first conductor contact portion 113*a*, and a second conductor contact portion 113*b*. The first conductor contact portion 113*a* is at one end of the electrically-conducting path 113, and the second conductor contact portion 113*b* is at the other end of the electrically-conducting path 113.

When the film 112 is affixed to the elastic body 111, the first conductor contact portion 113*a* is located on the upper surface of the elastic body 111. The first conductor contact portion 113*a* is capable of being brought into contact with a terminal portion of one of the to-be-connected objects of the connector 101.

When the film 112 is affixed to the elastic body 111, the second conductor contact portion 113*b* is located on the lower surface of the elastic body 111. The second conductor contact portion 113*b* is capable of being brought into contact with a terminal portion of the other of the to-be-connected objects of the connector 101.

As shown in FIG. 4, a plurality of holes 114 are formed in the first and second conductor contact portions 113*a* and 113*b*. Each hole 114 has a rhombic shape. The holes 114 are arranged in a matrix, and hence the first conductor contact portion 113*a* and the second conductor contact portion 113*b* are substantially mesh-shaped.

Figure 5:
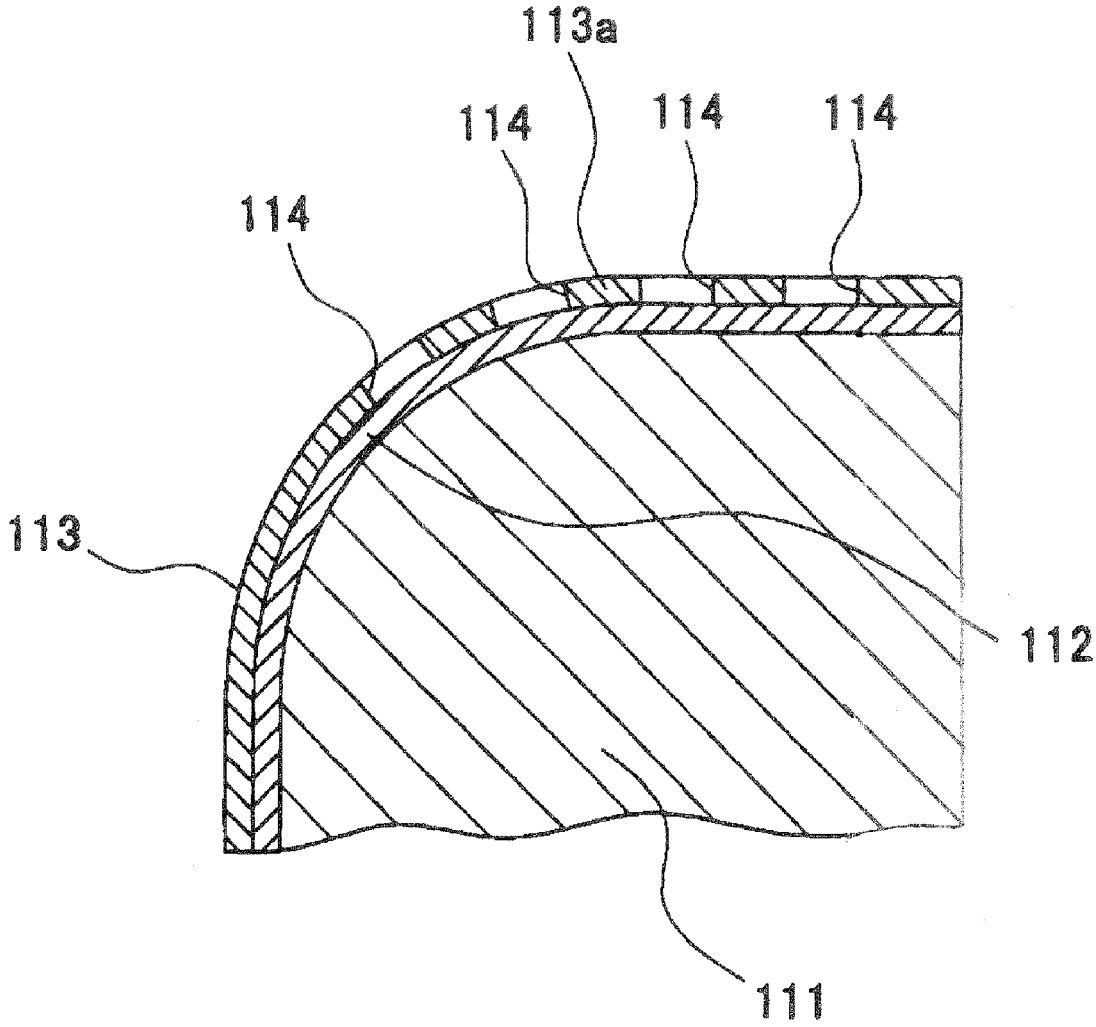
FIG. 5 is an enlarged cross-sectional view of an upper end of the FIG. 2 contact member.
Figure 6A:
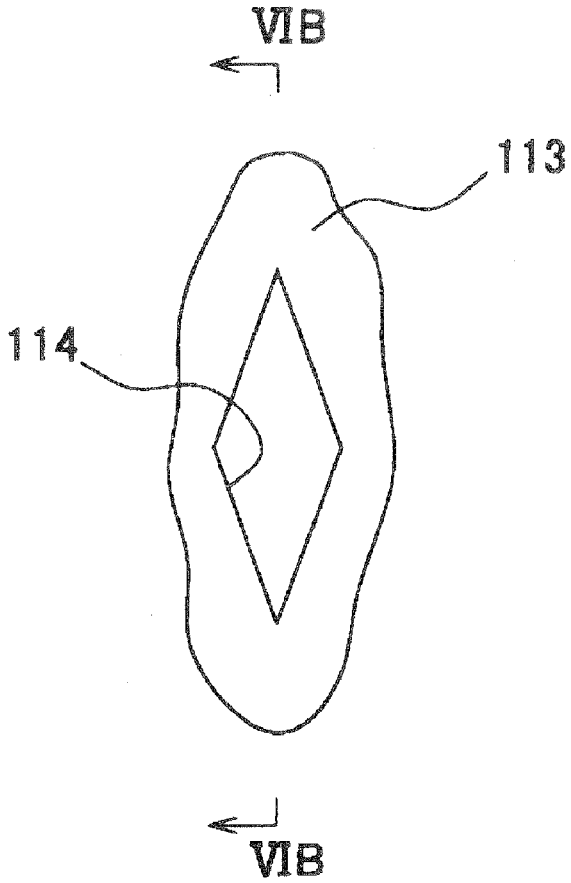
FIG. 6A is an enlarged plan view of a portion A appearing in FIG. 4.
Figure 6B:
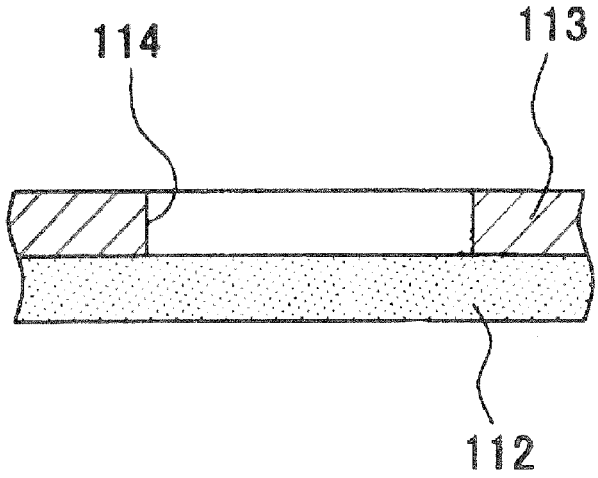
FIG. 6B is a cross-sectional view taken on line VIB-VIB of FIG. 6A.

As shown in FIGS. 5, 6A, and 6B, one opening of the hole 114 is closed by the film 112.

The insulating frame 117 is made of an insulating material, and is formed to be substantially plate-shaped, as shown in FIG. 1. Three holding holes 117*a* are formed through the insulating frame 117. The holding holes 117*a* extend in the longitudinal direction L17 of the insulating frame 117, and are arranged in three rows in a transverse direction S17 of the insulating frame 117. The contact members 110 are inserted in the holding holes 117*a*, and the contact members 110 has intermediate portions thereof held in the insulating frame 117. When the contact members 110 are held in the insulating frame 117, the upper and lower ends of the contact members 110 protrude out of the holding holes 117*a*.

To use the connector 101, the connector 101 is sandwiched between two to-be-connected objects (e.g. between a circuit board and a circuit board, or between a circuit board and a semiconductor device) and the two to-be-connected objects and the connector 101 sandwiched therebetween are connected by appropriate connecting means (e.g. bolts and nuts).

When the connector 101 is sandwiched by the two to-be-connected objects, the elastic body 111 is deformed by compression, and the first and second conductor contact portions 113*a* and 113*b* are pressed against the terminal portions of the two to-be-connected objects, respectively, by the restoring force of the elastic body 111, whereby the terminal portions of the to-be-connected objects are electrically connected to each other via the electrically-conducting paths 113.

Figure 7:
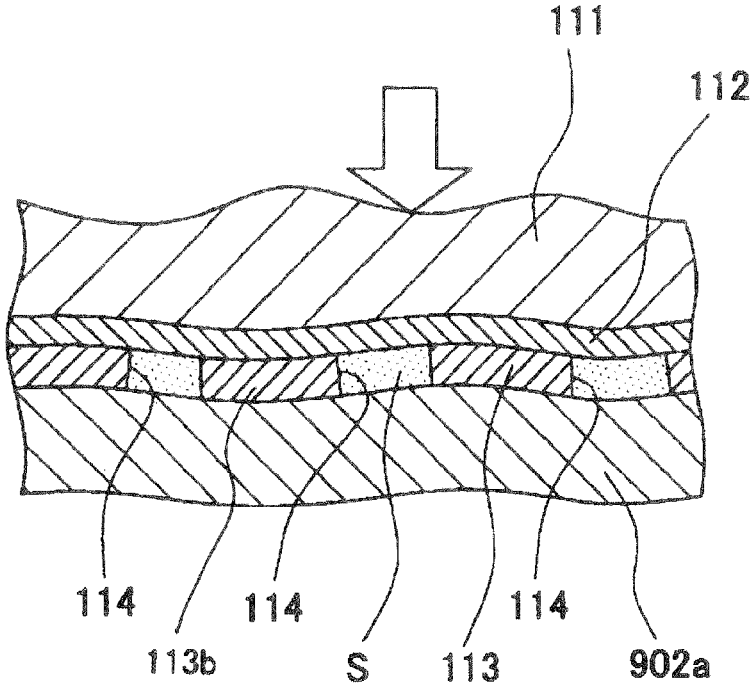
FIG. 7 is a cross-sectional view of a lower end of the FIG. 2 contact member during use.

For example, as shown in FIG. 7, if a contaminant S having flowability, such as silicone oil/adheres to a terminal portion 902*a* of a to-be-connected object, the contaminant S gets into holes 114 of the second conductor contact portion 113*b* of the electrically-conducting path 113, which enables the second conductor contact portion 113*b* to be positively brought into contact with the terminal portion 902*a*.

If the contaminant is hard dust, the first and second conductor contact portions 113*a* and 113*b* are deformed in a manner enveloping the contaminant. This is because the flexibility of the electrically-conducting path 113 has been improved by the holes 114. Therefore, the first and second conductor contact portions 113*a* and 113*b* are positively brought into contact with the terminal portions 902*a* of the mating to-be-connected object.

Figure 8A:
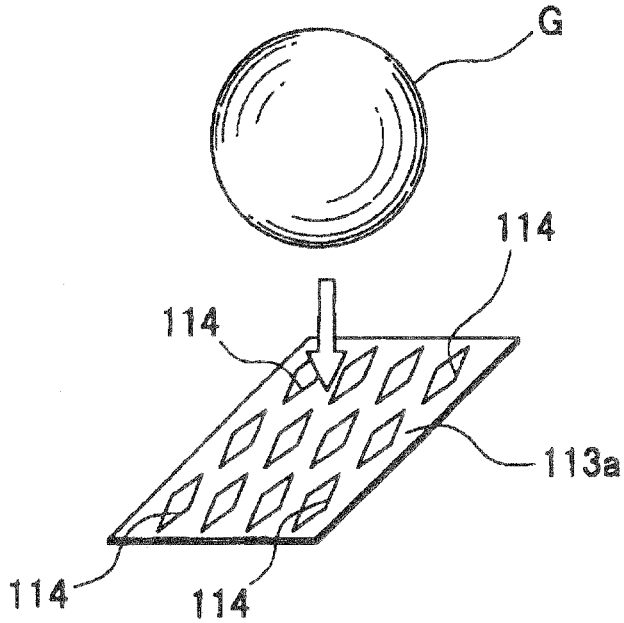
FIG. 8A is a conceptual view of a conductor contact portion of the FIG. 2 contact member in a state before being brought into contact with a solder ball of a ball grid array.
Figure 8B:
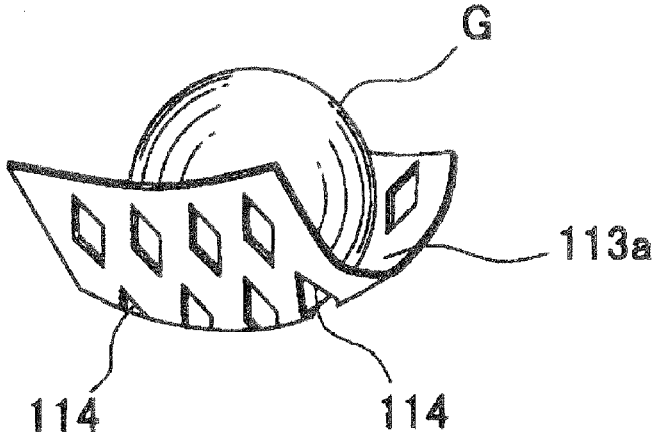
FIG. 8B is a conceptual view of the conductor contact portion of the FIG. 2 contact member in a state in contact with the solder ball of the ball grid array.
Figure 8C:
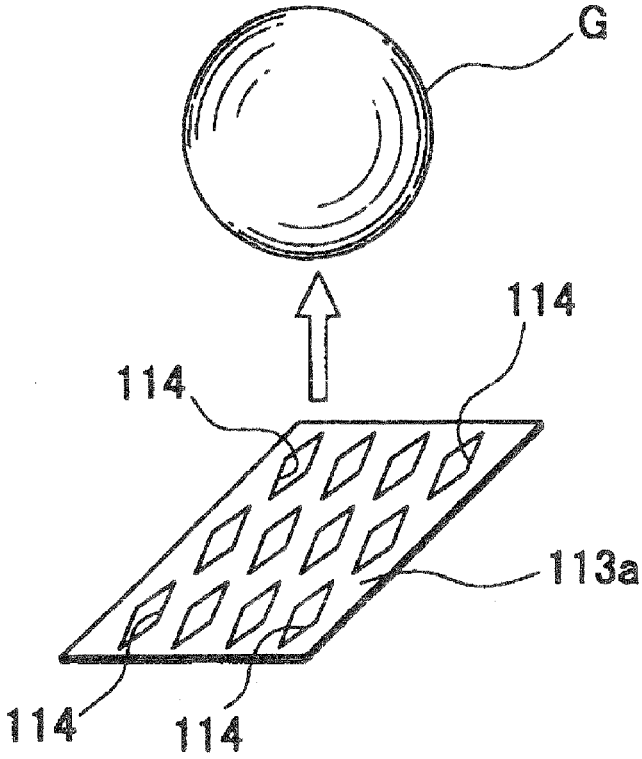
FIG. 8C is a conceptual view of the conductor contact portion of the FIG. 2 contact member in a state moved away from the solder ball of the ball grid array.

FIG. 8A is a conceptual view of the conductor contact portion 113*a* of the FIG. 2 contact member 110 in a state before being brought into contact with a solder ball G of a ball grid array. FIG. 8B is a conceptual view of the conductor contact portion 113*a* of the FIG. 2 contact member 110 in a state in contact with the solder ball G of the ball grid array. FIG. 8C is a conceptual view of the conductor contact portion 113*a* of the FIG. 2 contact member 110 in a state moved away from the solder ball G of the ball grid array.

As shown in FIG. 8A, before the solder ball G of the ball grid array (terminal portion of the to-be-connected object, not shown) is brought into contact with the first conductor contact portion 113*a* of the contact member 110 appearing in FIG. 2, the first conductor contact portion 113*a* is substantially flat.

As shown in FIG. 8B, when the solder ball G of the ball grid array is brought into contact with the first conductor contact portion 113*a*, the first conductor contact portion 113*a* is elastically deformed such that it is brought into close contact with the spherical surface of the solder ball G of the ball grid array, since the first conductor contact portion 113*a* is mesh-shaped. As a result, the first conductor contact portion 113*a* is positively brought into contact with the solder ball G of the ball grid array.

Since the flexibility of the first conductor contact portion 113*a* is improved by the holes 114, when the first conductor contact portion 113*a* is brought into close contact with the solder ball G of the ball grid array, the first conductor contact portion 113*a* is not plastically deformed, so that when the solder ball G of the ball grid array is moved away from the first conductor contact portion 113*a*, there remain no wrinkles.

Conventionally, there have been proposed a contact member having a conductor contact portion formed in a spiral shape and a contact member having a conductor contact portion formed with a cross-shaped cut, f or improved contact properties. In the conventional contact members, however, if a solder ball G of a ball grid array is brought into contact with the conductor contact portion off the center thereof, for example, the conductor contact portion is not sufficiently elastically deformed, so that the solder ball of the ball grid array cannot be brought into sufficient contact with the conductor contact portion. Further, wrinkles sometimes remain in a portion brought into contact with the solder ball of the ball grid array.

In contrast, in the connector according to the first embodiment, even if a solder ball G of a ball grid array is brought into contact with the first conductor contact portion 113*a* off the center thereof, the solder ball G of the ball grid array is positively brought into contact with the conductor contact portion 113*a* since the first conductor contact portion 113*a* has a high flexibility. Further, wrinkles are difficult to remain in a portion brought into contact with the solder ball G of the ball grid array.

As shown in FIG. 8C, when the solder ball G of the ball grid array is moved away from the first conductor contact portion 113*a*, the first conductor contact portion 113*a* returns to its original flat state by the restoring force of the elastic body 111. Even if the conductor contact portion 113*a* returns to the original flat state, there are not wrinkles remaining in the first conductor contact portion 113*a*.

It should be noted that the above-described relationship between the first conductor contact portion 113*a* and the solder ball G of the ball grid array also holds true when a solder ball G of a ball grid array is brought into contact with the second conductor contact portion 113*b*.

According to the present embodiment, since the holes 114 are formed in the first and second conductor contact portions 113*a* and 113*b*, even if a contaminant adheres to terminal portions of to-be-connected objects, the first and second conductor contact portions 113*a* and 113*b* are positively brought into contact with the associated terminal portions of the to-be-connected objects.

Further, the first and second conductor contact portions 113*a* and 113*b* has the flexibility thereof improved by the holes 114, and hence they are resistant to formation of wrinkles.

Figure 9:
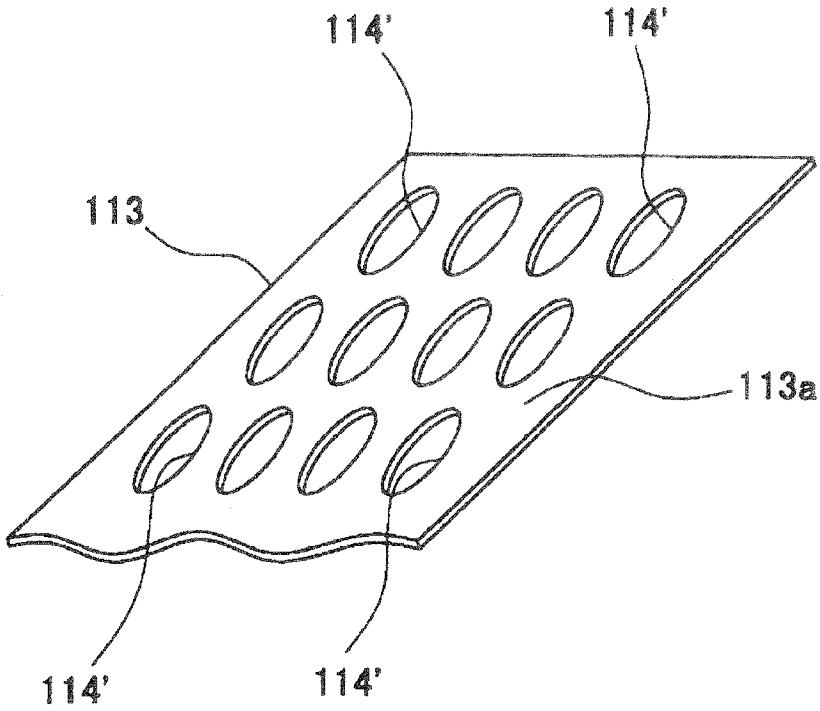
FIG. 9 is a perspective view of a first variation of the first conductor contact portion of the electrically-conducting path of the contact member of the connector according to the first embodiment.

FIG. 9 is a perspective view of a first variation of the first conductor contact portion of the electrically-conducting path of the contact member of the connector according to the first embodiment. The following description will be given of only main different parts from those of the first embodiment.

As shown in FIG. 9, as distinct from the first embodiment in which the rhombic holes 114 are formed in the first and second conductor contact portions 113*a* and 113*b* of the electrically-conducting path 113 of the contact member 110, in this variation, circular or elliptic holes 114' are formed in the first conductor contact portion 113*a* of the electrically-conducting path 113 of the variation. The circular holes 114' are also formed in the second conductor contact portion 113*b* of the electrically-conducting path 113, not shown.

According to this variation, it is possible to obtain the same advantageous effects as provided by the first embodiment.

Figure 10:
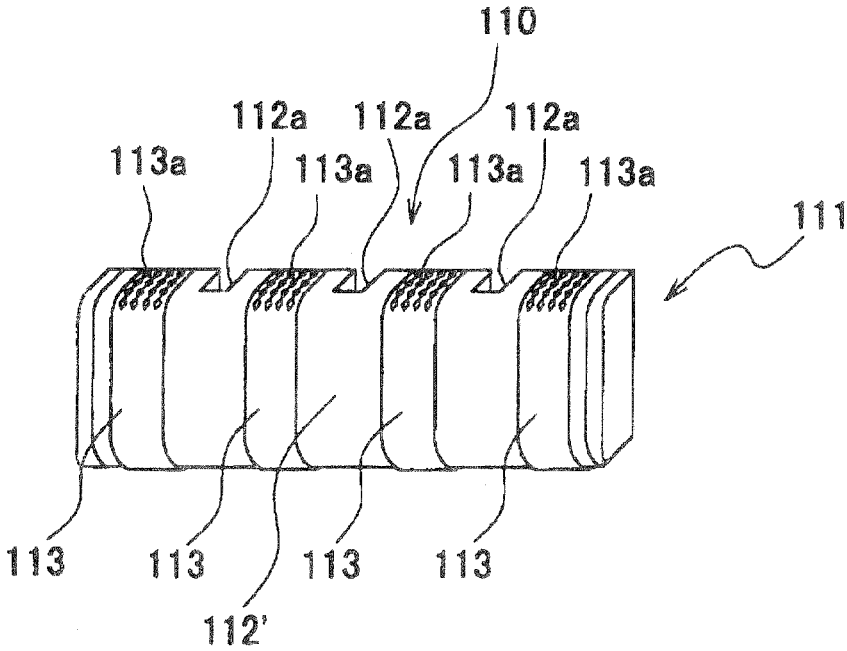
FIG. 10 is a perspective view of a second variation of the contact member of the connector according to the first embodiment of the present invention.
Figure 11:
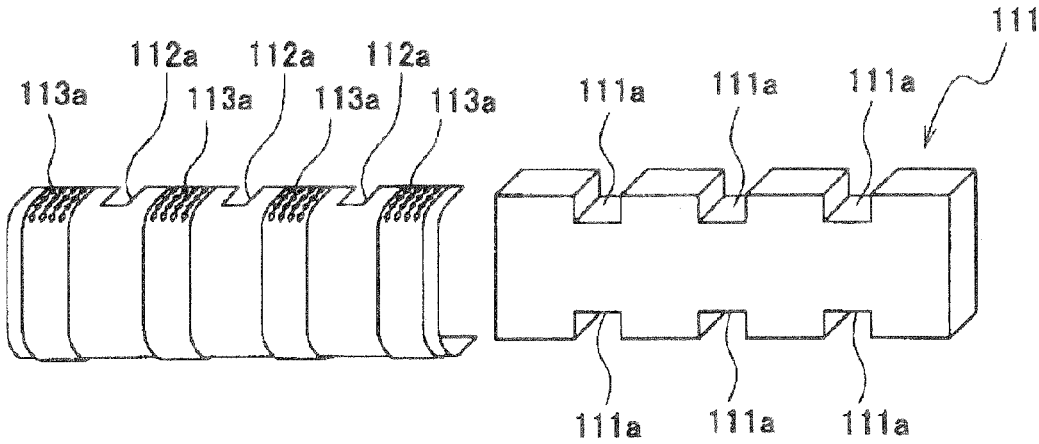
FIG. 11 is an exploded perspective view of the contact member shown in FIG. 10.
Figure 12:
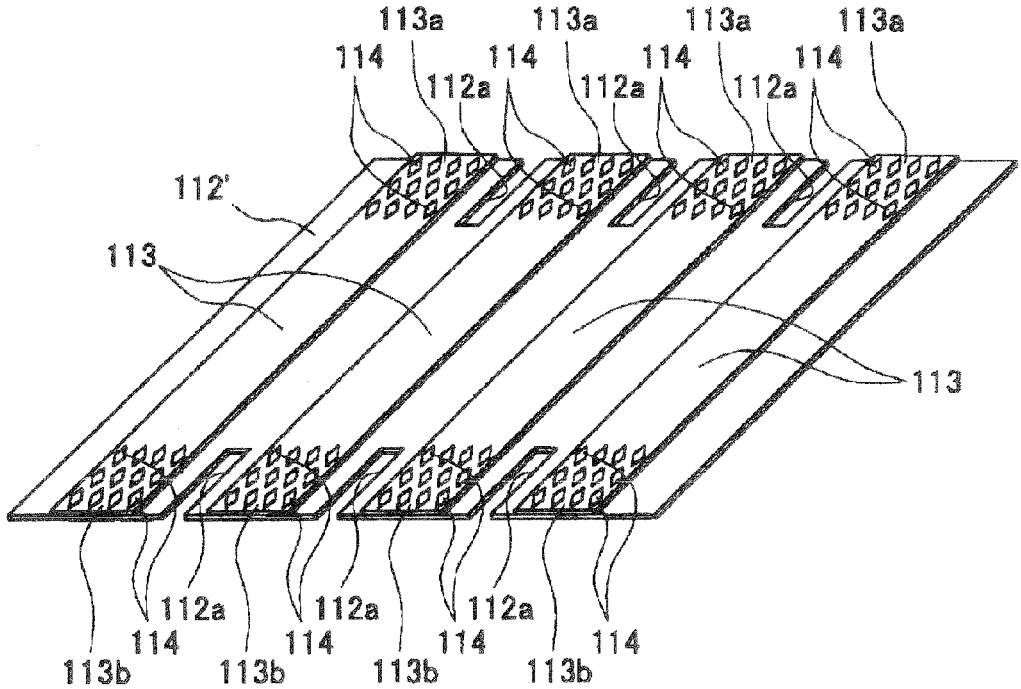
FIG. 12 is a perspective view of a film and electrically-conducting paths of the FIG. 10 contact member in a developed state.

FIG. 10 is a perspective view of a second variation of the contact member 110 of the connector according to the first embodiment of the present invention. FIG. 11 is an exploded perspective view of the FIG. 10 contact member 110. FIG. 12 is a perspective view of a film 112' and electrically-conducting paths 113 of the FIG. 10 contact member 110, in a developed state.

Component parts identical to those of the contact member according to the first embodiment are denoted by identical reference numerals, and detailed description thereof is omitted. The following description will be given of only main different parts from those of the first embodiment.

As shown in FIGS. 10 to 12, in this second variation, cutouts 112*a* are formed in a film 112' of the contact member 110. The cutouts 112*a* are opposed to the cutouts 111*a* formed in the upper end and the lower end of the elastic body 111 when the film 112' is affixed to the elastic body 111.

According to this second variation, it is possible to obtain the same advantageous effects as provided by the first embodiment. Further, it is possible to improve followability (close contactness) of the first and second conductor contact portions 113*a* and 113*b* to the terminal portions of the to-be-connected objects.

Figure 13:
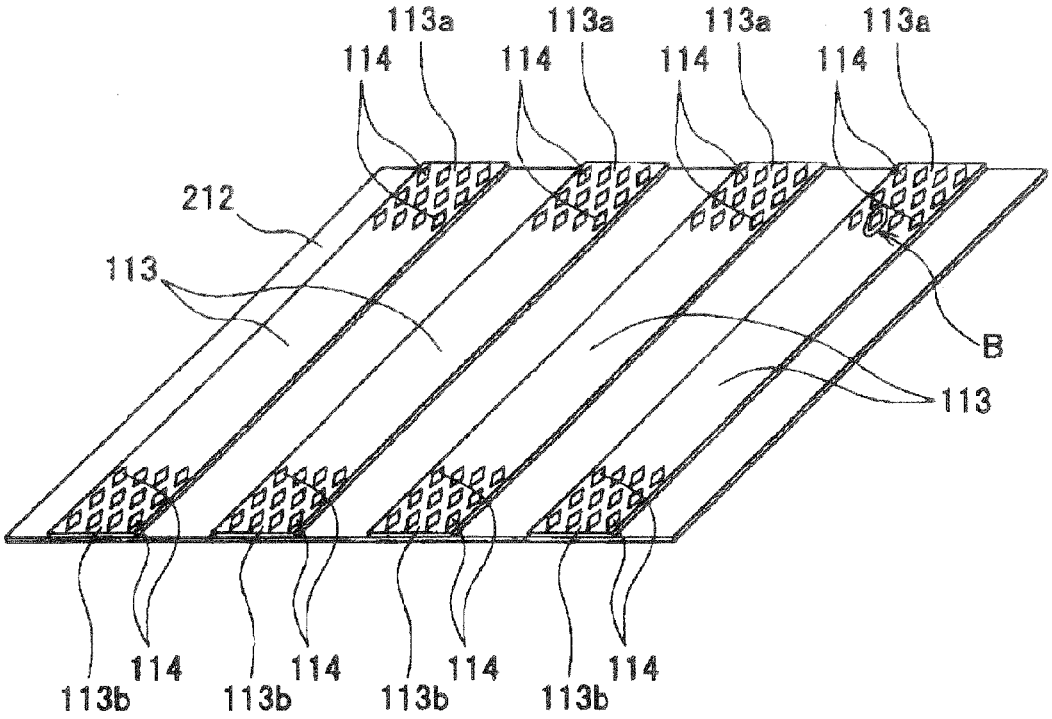
FIG. 13 is a perspective view of a film and electrically-conducting paths of a contact member of a connector according to a second embodiment of the present invention, in a developed state.
Figure 14A:
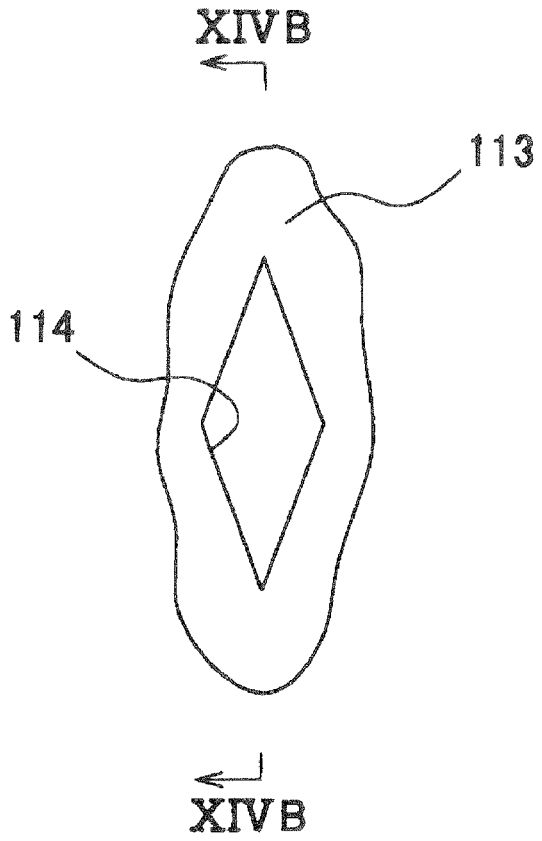
FIG. 14A is an enlarged plan view of a portion B appearing in FIG. 13.
Figure 14B:
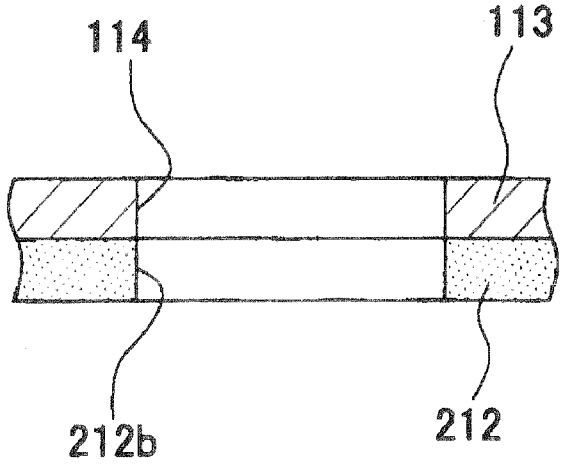
FIG. 14B is a cross-sectional view taken on line XIVB-XIVB of FIG. 14A.

FIG. 13 is a perspective view of a film 212 and electrically-conducting paths 113 of a contact member of a connector according to a second embodiment of the present invention, in a developed state. FIG. 14A is an enlarged plan view of a portion B appearing in FIG. 13. FIG. 14B is a cross-sectional view taken on line XIVB-XIVB of FIG. 14A.

Component parts identical to those of the contact member according to the first embodiment are denoted by identical reference numerals, and detailed description thereof is omitted. The following description will be given of only main different parts from those of the first embodiment.

The second embodiment is distinguished from the first embodiment in the construction of a film 212. As shown in FIG. 14B, deformation acceleration holes 212*b* are formed in the film 212, in a manner opposed to the holes 114 in the electrically-conducting path 113. The shape of each deformation acceleration hole 212*b* is the same as the shape of each hole 114. The deformation acceleration holes 212*b* make the film 212 easier to be deformed.

According to the second embodiment, the first and second conductor contact portions 113*a* and 113*b* are made easier to be elastically deformed by the deformation acceleration holes 212*b*, and hence the contact stability of the connector is improved.

Figure 15A:
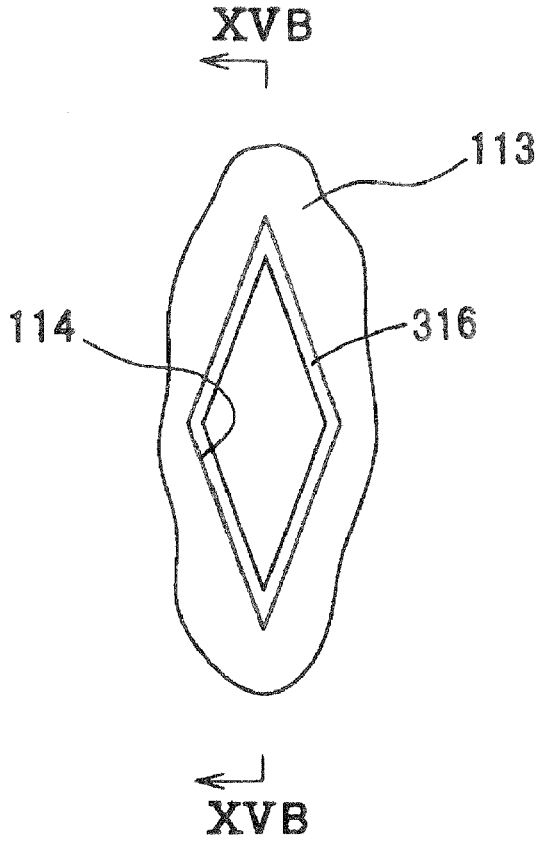
FIG. 15A is an enlarged plan view of a portion corresponding to FIG. 6A of a film and an electrically-conducting path of a contact member of a connector according to a third embodiment of the present invention.
Figure 15B:
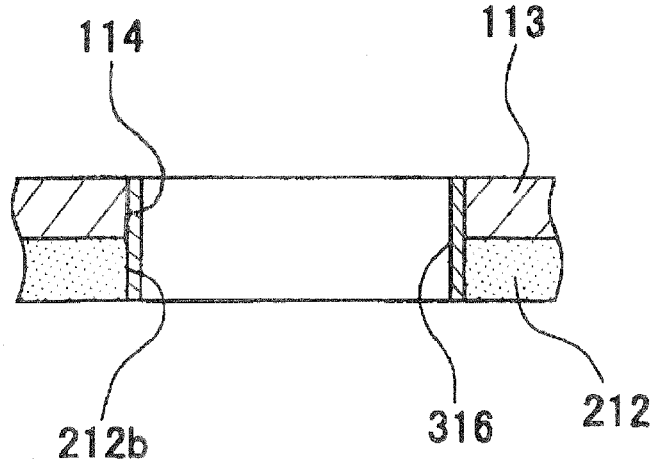
FIG. 15B is a cross-sectional view taken on line XVB-XVB of FIG. 15A.

FIG. 15A is an enlarged plan view of a portion corresponding to FIG. 6A of a film 212 and an electrically-conducting path 113 of a contact member of a connector according to a third embodiment of the present invention. FIG. 15B is a cross-sectional view taken on line XVB-XVB of FIG. 15A.

Component parts identical to those of the contact member according to the first and second embodiments are denoted by identical reference numerals, and detailed description thereof is omitted. The following description will be given of only main different parts from those of the first and second embodiments.

As shown in FIGS. 15A and 15B, a conductor layer 316 is formed on the inner peripheral surface of the hole 114 of the electrically-conducting path 113 and on the inner peripheral surface of the deformation acceleration hole 212*b* of the film 212.

The conductor layer 316 prevents water or the like from seeping in between the electrically-conducting path 113 and the film 112, and hence this makes it possible to prevent the electrically-conducting path 113 from peeling off or being corroded.

According to the third embodiment, it is possible to obtain the same advantageous effects as provided by the first and second embodiments, and at the same time improve the durability of the contact member.

Figure 16A:
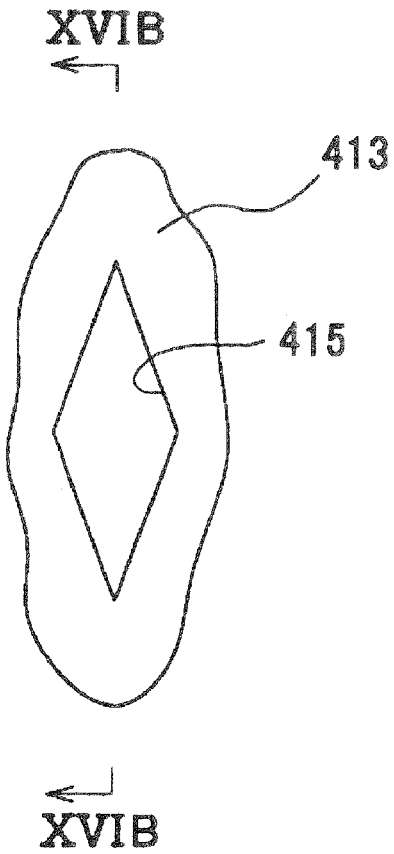
FIG. 16A is an enlarged plan view of a portion corresponding to FIG. 6A of a film and an electrically-conducting path of a contact member of a connector according to a fourth embodiment of the present invention.
Figure 16B:
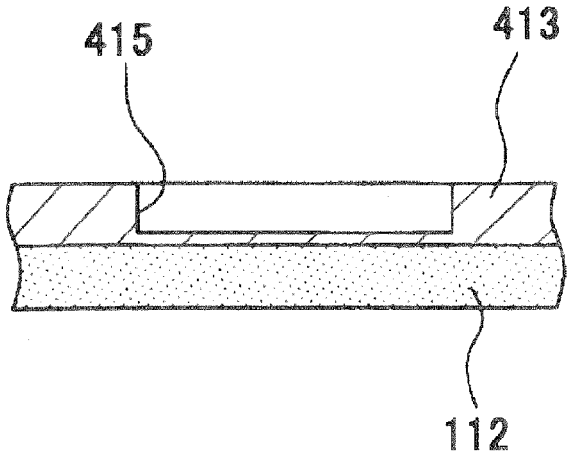
FIG. 16B is a cross-sectional view taken on line XVIB-XVIB of FIG. 16A.

FIG. 16A is an enlarged plan view of a portion corresponding to FIG. 6A of a film 212 and an electrically-conducting path 413 of a contact member of a connector according to a fourth embodiment of the present invention. FIG. 16B is a cross-sectional view taken on line XVIB-XVIB of FIG. 16A.

Component parts identical to those of the contact member according to the first embodiment are denoted by identical reference numerals, and detailed description thereof is omitted. The following description will be given of only main different parts from those of the first embodiment.

As distinct from the first embodiment in which the holes 114 are formed in each electrically-conducting path 113, in the fourth embodiment, recesses 415 are formed in each electrically-conducting path 413 in place of the holes 114, as shown in FIGS. 16A and 16B.

According to the fourth embodiment, it is possible to obtain the same advantageous effects as provided by the first embodiment. Further, it is possible to prevent water or the like from seeping in between the electrically-conducting path 413 and the film 112, and hence to prevent the electrically-conducting path 413 from peeling off or being corroded. Therefore, it is possible to improve the durability of the contact member.

Figure 17A:
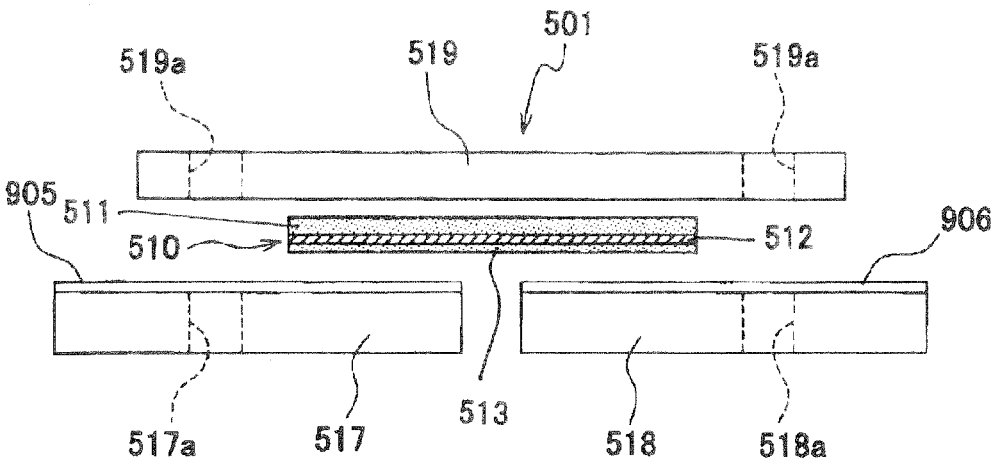
FIG. 17A is a front view showing circuit boards in a state before being connected to each other by a connector according to a fifth embodiment of the present invention.
Figure 17B:
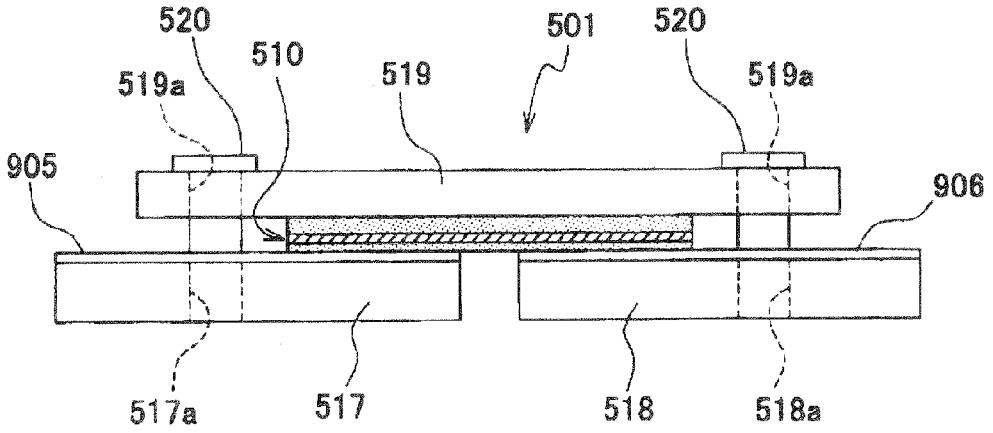
FIG. 17B is a front view showing the circuit boards in a state connected to each other by the connector appearing in FIG. 17A.
Figure 18:
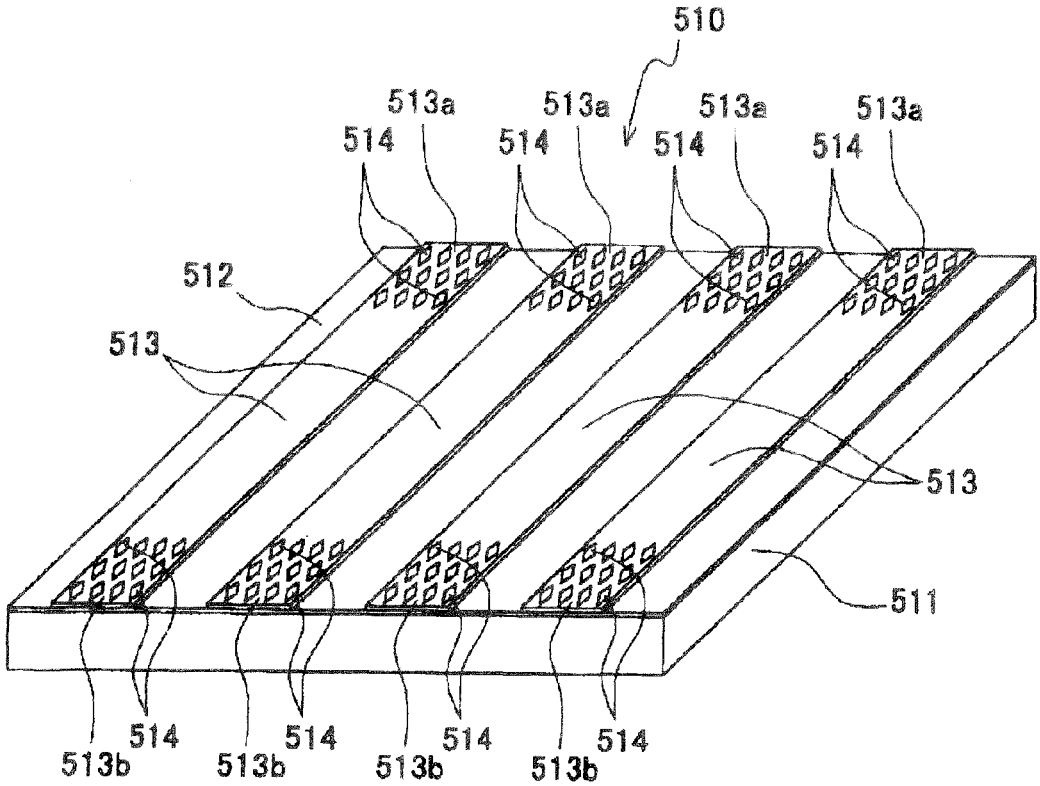
FIG. 18 is a perspective view of a contact member of the connector appearing in FIG. 17A.

FIG. 17A is a front view showing circuit boards in a state before being connected to each other by a connector according to a fifth embodiment of the present invention. FIG. 17B is a front view showing the circuit boards in a state connected to each other by the connector appearing in FIG. 17A. FIG. 18 is a perspective view of a contact member 510 of the connector appearing in FIG. 17A.

As shown in FIGS. 17A and 17B, the connector 501 includes the contact member 510, a first substrate 517 (insulating frame), a second substrate 518 (insulating frame), and a holding plate 519.

As shown in FIG. 18, the contact member 510 includes an elastic body 511, a film 512, and a plurality of electrically-conducting paths 513.

The elastic body 511 is made of an elastic material having insulation properties (e.g. gum or gel), and is substantially plate-shaped.

The film 512 is affixed to the elastic body 511 in a manner covering an upper surface of the elastic body 511. Polyimide, aramid or the like is suitable for the material of the film 512.

The electrically-conducting paths 513 are formed on the surface of the film 512 at equally-spaced intervals in a predetermined direction. Each electrically-conducting path 513 is a substantially belt-shaped metal thin film. The electrically-conducting path 513 is formed e.g. by sputtering and etching. The electrically-conducting path 513 includes a first conductor contact portion 513*a* and a second conductor contact portion 513*b*. The first conductor contact portion 513*a* is at one end of the electrically-conducting path 513, and the second conductor contact portion 513*b* is at the other end of the electrically-conducting path 513.

The first conductor contact portion 513*a* is capable of being brought into contact with a terminal portion (not shown) of a first circuit board 905 which is one of objects to be connected to the connector 501.

The second conductor contact portion 513*b* is capable of being brought into contact with a terminal portion (not shown) of a second circuit board 906 which is the other of the objects to be connected to the connector 501.

As shown in FIG. 18, a plurality of holes 514 are formed in the first and second conductor contact portions 513*a* and 513*b*. Each hole 514 has a rhombic shape. The holes 514 are arranged in a matrix, and hence the first conductor contact portion 513*a* is substantially mesh-shaped.

Screw holes 517*a* are formed through the first substrate 517. The first substrate 517 holds the first circuit board 905.

Screw holes 518*a* are formed through the second substrate 518. The second substrate 518 holds the second circuit board 906.

Screw insertion holes 519*a* are formed through the holding plate 519.

To connect the first and second circuit boards 905 and 906 to each other by the connector 501, first, the first and second circuit boards 905 and 906 are disposed on the first and second substrates 517 and 518, respectively.

Next, the contact member 510 is disposed on the first and second circuit boards 905 and 906. At this time, the contact member 510 is disposed in a manner forming a bridge between the first and second circuit boards 905 and 906.

Then, the holding plate 519 is disposed on the contact member 510.

Finally, screws 520 and 520 are screwed into the screw holes 517*a* and 518*a* through the screw insertion holes 519*a* and 519*b* (see FIG. 17B), respectively.

When the contact member 510 is sandwiched by the first and second substrates 517 and 518 and the holding plate 519, the elastic body 511 is compressed, so that the first and second conductor contact portions 513*a* and 513*b* are pressed against the terminal portions of the first and second circuit boards 905 and 906, respectively, by the restoring force of the elastic body 511. As a result, the terminal portions of the two circuit boards 905 and 906 are electrically connected to each other by the electrically-conducting paths 513.

According to the fifth embodiment, it is possible to obtain the same advantageous effects as provided by the first embodiment.

Figure 19:
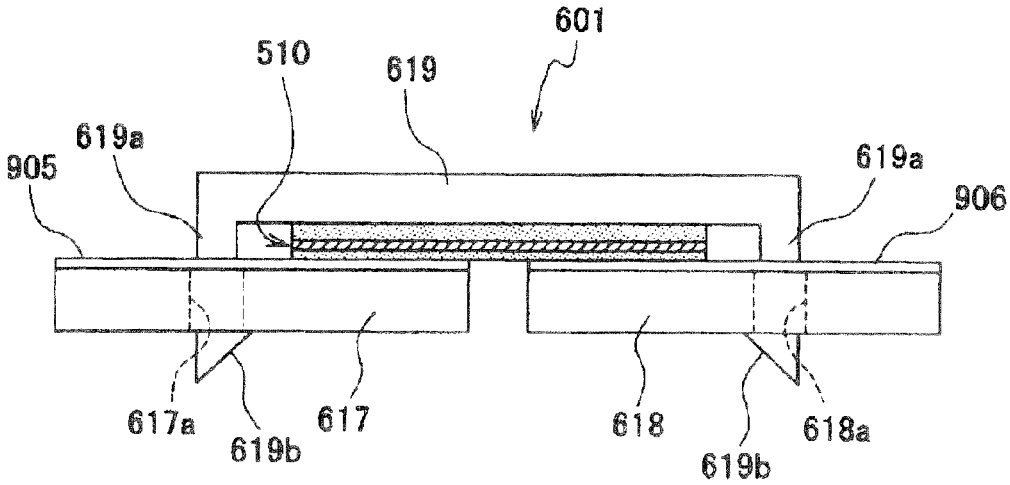
FIG. 19 is a front view showing circuit boards in a state connected to each other by a connector according to a sixth embodiment of the present invention.

FIG. 19 is a front view showing circuit boards in a state connected to each other by a connector according to a sixth embodiment of the present invention.

Component parts identical to those of the contact member according to the fifth embodiment are denoted by identical reference numerals, and detailed description thereof is omitted. The following description will be given of only main different parts from those of the fifth embodiment.

As distinct from the fifth embodiment in which the holding plate 519 is fixed to the first and second substrates 517 and 518 by the screws 520, in the sixth embodiment, a holding plate 619 is fixed to the first and second substrates 617 and 618 by a lock mechanism, as shown in FIG. 19.

The holding plate 619 includes a pair of arms 619*a* having elasticity, and lugs 619*b* formed at front ends of the arms 619*a*.

The first and second substrates 617 and 618 have holes 617*a* and 618*a* formed therethrough, respectively for having the arms 619*a* and lugs 619*b* pass therethrough.

When the arms 619*a* and lugs 619*b* of the holding plate 619 are inserted into the holes 617*a* and 618*a* of the first and second substrates 617 and 618, respectively, the inner surfaces of the holes 617*a* and 618*a* and the lugs 619*b* are engaged, and the arms 619*a* are elastically deformed outward. When the lugs 619*b* pass through the holes 617*a* and 618*a*, the inner surfaces of the holes 617*a* and 618*a* and the lugs 619*b* are disengaged, and then the arms 619*a* each return to the original state. As a result, respective portions of the lugs 619*b* are engaged with the lower surfaces of the first and second substrates 617 and 618, respectively, whereby the holding plate 619 is locked to the first and second substrates 617 and 618.

According to the sixth embodiment, it is possible to obtain the same advantageous effects as provided by the fifth embodiment. Further, it is possible to easily fix the holding plate 619 to the first and second substrates 617 and 618, which improves workability.

Figure 20:
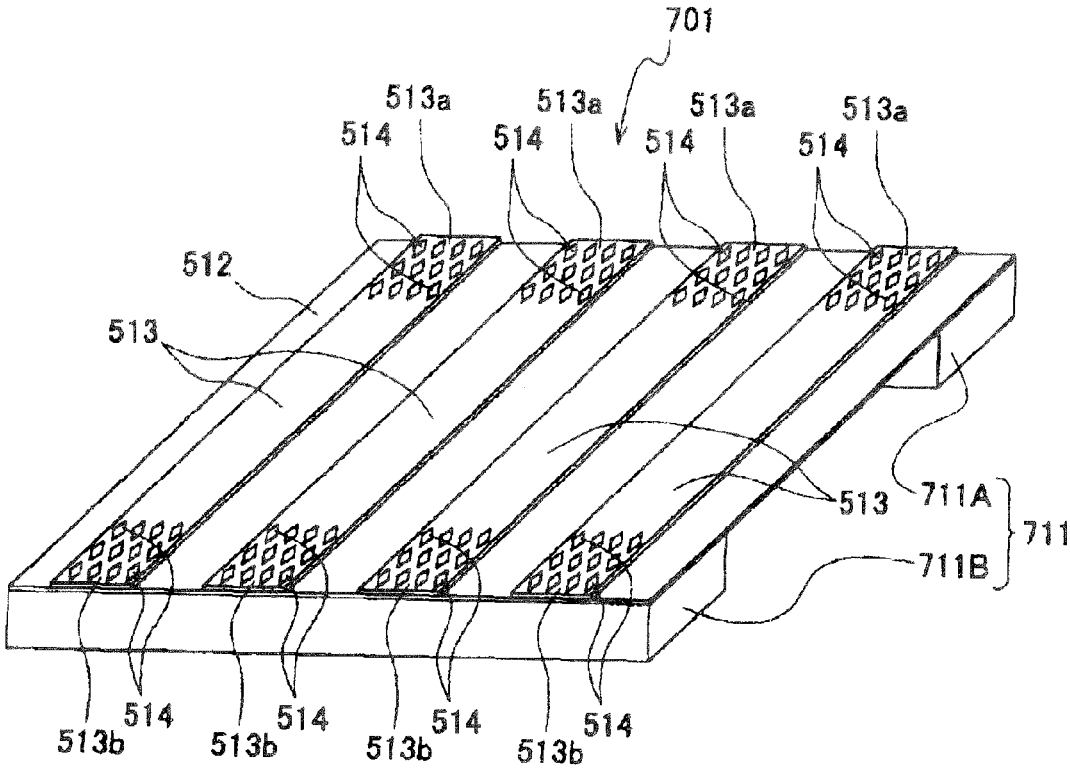
FIG. 20 is a perspective view of a contact member of a connector according to a seventh embodiment of the present invention.

FIG. 20 is a perspective view of a contact member 710 of a connector according to a seventh embodiment of the present invention.

Component parts identical to those of the contact member according to the fifth embodiment are denoted by identical reference numerals, and detailed description thereof is omitted. The following description will be given of only main different parts from those of the fifth embodiment.

As distinct from the fifth embodiment in which the elastic body 511 is comprised of one elastic member, in the seventh embodiment, as shown in FIG. 20, an elastic body 711 is comprised of a first elastic member 711A which supports the first conductor contact portions 513*a* of the electrically-conducting paths 513, and a second elastic member 711B which supports the second conductor contact portions 513*b* of the electrically-conducting paths 513.

According to the seventh embodiment, it is possible to obtain the same advantageous effects as provided by the fifth embodiment. Further, it is possible to increase the degree of freedom of the manner of contact between the two to-be-connected objects.

Although in the above-described embodiments, a plurality of holes 114, 114', and 514, or recesses 415 are formed in one conductor contact portion, this is not limitative, but one hole or one recess may be formed in the conductor contact portion.

Further, although in the above-described embodiments, the deformation acceleration holes 212*b* are formed in a manner opposed to the holes 114, the deformation acceleration holes 212*b* are not necessarily required to be opposed to the holes 114.

It should be noted that although in the second embodiment, one deformation acceleration hole 212*b* is provided for one hole 114, one large deformation acceleration hole may be provided for a plurality of holes 114.

It is further understood by those skilled in the art that the foregoing are the preferred embodiments of the present invention, and that various changes and modification may be made thereto without departing from the spirit and scope thereof.

What is claimed is:

1. A contact member comprising:

an elastic body that is substantially plate-shaped;

a film that is affixed to a surface of said elastic body; and an electrically-conducting path that is disposed on a surface of said film for electrically connecting between terminal portions of two to-be-connected objects, said electrically-conducting path including a first conductor contact portion that is capable of being brought into contact with a terminal portion of one of said two to-be-connected objects, and a second conductor contact portion that is capable of being brought into contact with a terminal portion of the other of said two to-be-connected objects, said first and second conductor contact portions having recesses formed therein.

2. A contact member as claimed in claim 1, wherein said recesses are scattered over substantially a whole of said first and second conductor contact portions.

3. A contact member comprising:

an elastic body that is substantially plate-shaped;

a film that is affixed to a surface of said elastic body; and an electrically-conducting path that is disposed on a surface of said film for electrically connecting between terminal portions of two to-be-connected objects, said electrically-conducting path including a first conductor contact portion for contacting a terminal portion of one of said two to-be-connected objects, and a second conductor contact portion for contacting a terminal portion of the other of said two to-be-connected objects, said first and second conductor contact portions having holes formed therein, wherein deformation acceleration holes opposed to said holes are formed in said film.

4. A contact member as claimed in claim 3, wherein a conductor layer continuing into said electrically-conducting path is formed on an inner peripheral surface of each of said holes.

5. A contact member as claimed in claim 4, wherein said holes are scattered over substantially a whole of said first and second conductor contact portions.

6. A contact member as claimed in claim 3, wherein said holes are scattered over substantially a whole of said first and second conductor contact portions.

7. A contact member comprising:

an elastic body that is substantially plate-shaped;

a film that is affixed to a surface of said elastic body; and an electrically-conducting path that is disposed on a surface of said film for electrically connecting between terminal portions of two to-be-connected objects, said electrically-conducting path including a first conductor contact portion for contacting a terminal portion of one of said two to-be-connected objects, and a second conductor contact portion for contacting a terminal portion of the other of said two to-be-connected objects, said first and second conductor contact portions having holes formed therein, wherein a conductor layer continuing into said electrically-conducting path is formed on an inner peripheral surface of each of said holes.

8. A contact member as claimed in claim 7, wherein said holes are scattered over substantially a whole of said first and second conductor contact portions.

9. A connector comprising:

(i) a contact member including:

an elastic body that is substantially plate-shaped, a film that is affixed to a surface of said elastic body, and an electrically-conducting path that is disposed on a surface of said film for electrically connecting between terminal portions of two to-be-connected objects, said electrically-conducting path including a first conductor contact portion that is capable of being brought into contact with a terminal portion of one of said two to-be-connected objects, and a second conductor contact portion that is capable of being brought into contact with a terminal portion of the other of said two to-be-connected objects, said first and second conductor contact portions having recesses formed therein; and (ii) an insulating frame that holds said contact member.

10. A connector comprising:

(i) a contact member including:

an elastic body that is substantially plate-shaped, a film that is affixed to a surface of said elastic body, and an electrically-conducting path that is disposed on a surface of said film for electrically connecting between terminal portions of two to-be-connected objects, said electrically-conducting path including a first conductor contact portion for contacting a terminal portion of one of said two to-be-connected objects, and a second conductor contact portion for contacting a terminal portion of the other of said two to-be-connected objects, said first and second conductor contact portions having holes formed therein, wherein deformation acceleration holes opposed to said holes are formed in said film; and (ii) an insulating frame that holds said contact member.

* * * * *